US006684612B2

(12) United States Patent
Trottet

(10) Patent No.: US 6,684,612 B2
(45) Date of Patent: Feb. 3, 2004

(54) MACHINE FOR WRAPPING A LOAD WITH A DEVICE FOR PLEATING A WIDTH OF FILM

(75) Inventor: Alain Trottet, Aix les Bains Cedex (FR)

(73) Assignee: Illinois Tool Works Inc., Glenview, IL (US)

( * ) Notice: Subject to any disclaimer, the term of this patent is extended or adjusted under 35 U.S.C. 154(b) by 14 days.

(21) Appl. No.: 09/800,963

(22) Filed: Mar. 8, 2001

(65) Prior Publication Data

US 2002/0043053 A1 Apr. 18, 2002

(Under 37 CFR 1.47)

(30) Foreign Application Priority Data

Mar. 8, 2000 (FR) ..... 00 02967

(51) Int. Cl.[7] ..... B65B 11/04
(52) U.S. Cl. ..... 53/587; 53/556
(58) Field of Search ..... 53/556, 587, 588, 53/211

(56) References Cited

U.S. PATENT DOCUMENTS 4,152,879 A * 5/1979 Shulman ..... 53/587
4,255,918 A * 3/1981 Lancaster et al. ..... 53/556
4,271,657 A * 6/1981 Lancaster et al. ..... 53/587
4,432,185 A * 2/1984 Geisinger ..... 53/587
4,563,863 A * 1/1986 Humphrey ..... 53/556
5,081,824 A * 1/1992 Thimon et al. ..... 53/556
5,097,655 A * 3/1992 Thimon ..... 53/588
5,430,995 A * 7/1995 Cere ..... 53/556
5,575,138 A * 11/1996 Reigrut et al. ..... 53/556
5,941,049 A * 8/1999 Lancaster et al. ..... 53/587

FOREIGN PATENT DOCUMENTS

GB A-2143200 2/1985
GB A-2304320 3/1997

* cited by examiner

*Primary Examiner*—John Sipos
(74) *Attorney, Agent, or Firm*—Lowe Hauptman Gilman & Berner LLP

(57) ABSTRACT

The machine is intended to wind a width (6), with a top lateral edge (7) and a bottom lateral edge (8) of a reel (2) of wrapping film around the load. It comprises a reel holder (1) and a device (5) for pleating the width of film (6), this device being intended to bring the two lateral edges (7, 8) of the width (6) closer together. The pleating device (5) is designed to bring the two lateral edges (7, 8) of the width (6) closer together simply by slipping the top lateral edge (7) downwards.

4 Claims, 2 Drawing Sheets

MACHINE FOR WRAPPING A LOAD WITH A DEVICE FOR PLEATING A WIDTH OF FILM

Figure 1:
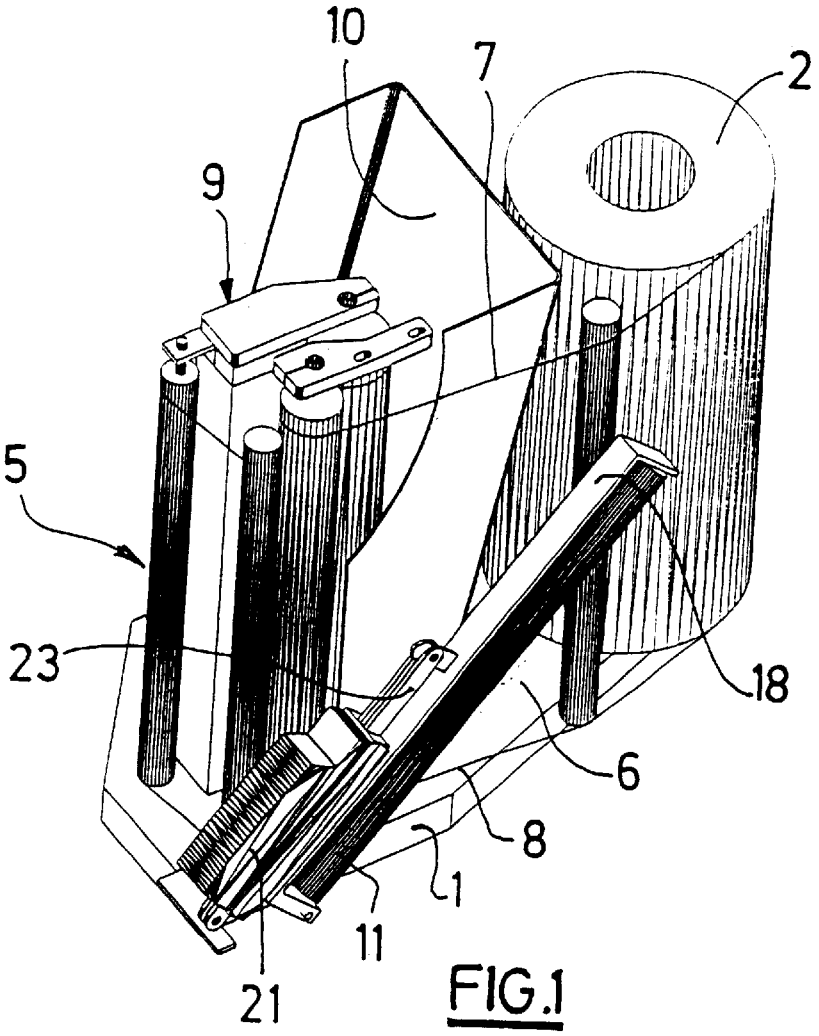

The invention relates to machines for wrapping loads intended to wind, or, as those skilled in the art would say, to "banderoll", a width of wrapping film, generally made of polyethylene, around these loads, from the bottom to the top, to protect them from dust and running moisture. These loads are generally placed on pallets.

Wrapping is performed either by rotating on a platform the load which pulls the width of film off a feed reel, being rolled up inside it, or by rotating an arm which pulls the width off the reel to wind it around the load. In any event, at the end of the wrapping cycle, the width has to be cut and welded at the bottom of the load using a cutting and welding gripper device.

As there may be a desire to wrap loads of different heights, the cutting and welding device with which wrapping machines are generally equipped is designed for minimal load height, and is therefore relatively short and often shorter than the breadth of the width of wrapping film on the feed reels. This is why wrapping machines are often also equipped with a so-called pleating device for adapting and reducing the breadth of the wrapping film upstream of the cutting and welding device, in the direction in which the width of film travels.

There are already known certain devices for pleating widths of films on wrapping machines comprising a frame, two freely rotating turn rolls, this being mounted so that it can pivot about a central axis of the frame perpendicular to its plane so as, with the width of film slipped between the two rolls of the frame, to twist it between two planes which are inclined with respect to one another by pivoting the frame and thus force the lateral edges of the width to slide towards each other against the rolls, towards the inside of the frame, in a pleating movement that reduces the edge-to-edge breadth.

Such pleating devices do, however, display drawbacks.

First of all, pivoting the pleating frame requires a certain amount of travel which increases the space required by the machine.

Secondly, and above all, as the lower lateral edge of the width moves closer to the axis of pivoting of the frame during pleating, and as it is thus moved upwards, the pleating device and the reel holder need to be lowered in order to be truly able to weld and cut at the base of the load, and this is also detrimental to the space required by the machine.

The present invention aims to alleviate these drawbacks.

To this end, it relates to a load wrapping machine for winding a width, with a top lateral edge and a bottom lateral edge of a reel of wrapping film around the load, comprising a reel holder, means for winding the width around the load, a device for cutting and welding the width and a device for pleating the width of film, this device being intended to bring the two lateral edges of the width closer together, the machine being characterized in that the pleating device is designed to bring the two lateral edges of the width closer together simply by sliding the top lateral edge downwards.

Thus, and by virtue of the invention, as the heightwise position of the bottom lateral edge of the width of wrapping film is not altered by the pleating device, the width can easily be cut and welded at the base of the load.

In the preferred embodiment of the machine of the invention, the pleating device comprises a distancing bar mounted articulated at its base and means for making the bar pivot on its base.

By inclining the bar about its base, its top part, or top, is distanced from the vertical through its base, distancing with it the top lateral edge of the width of film thus forcing the top portion of width adjacent to the top lateral edge, to slide along the distancing bar towards its base, that is to say downwards.

As a preference, the distancing bar is mounted so that it is free to rotate on itself.

As the width of film continues to pass through the pre-stretching and pleating device and the pivoting of the distancing bar distances the width of film gradually from the bottom upwards, and therefore gives rise to a speed gradient on the speed at which the width travels around the distancing bar, from the nominal speed of travel near the bottom of the bar to a maximum speed near the top lateral edge, it is advantageous for the distancing bar to comprise a number of portions which rotate independently of one another to prevent the top part of the width from rolling up on itself and forming a twist.

Still in a best attempt at avoiding the formation of twists, it is preferable for the distancing bar to comprise, towards its top, friction means intended to apply relative retention to the width of film, for example projections, asperities, roughnesses, raised striations.

Figure 2:
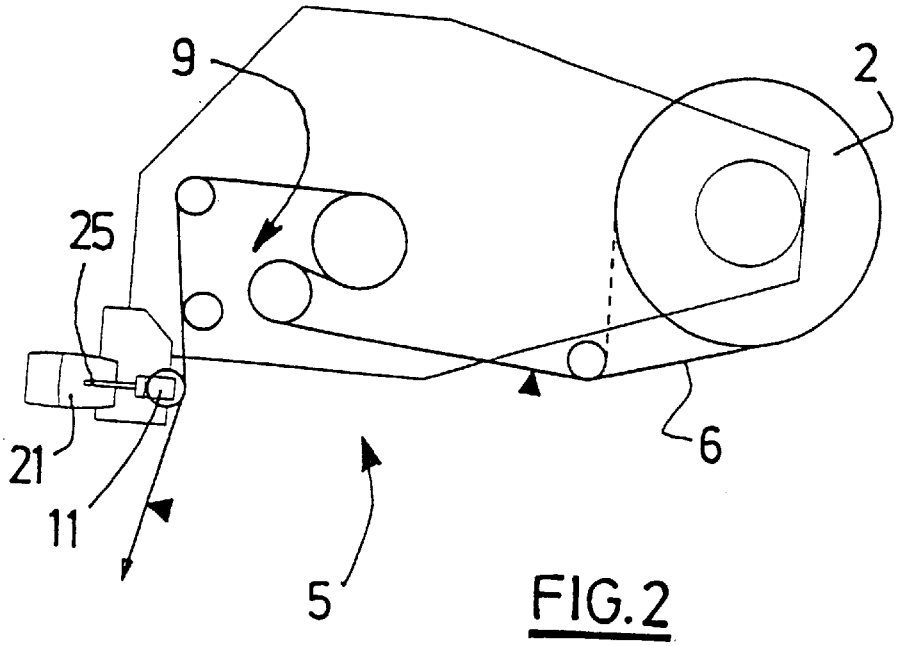
Figure 4:
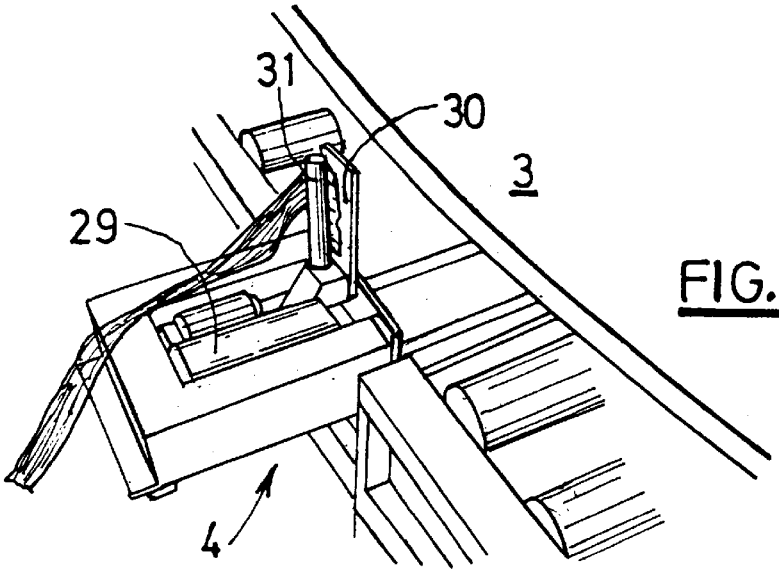
Figure 5:
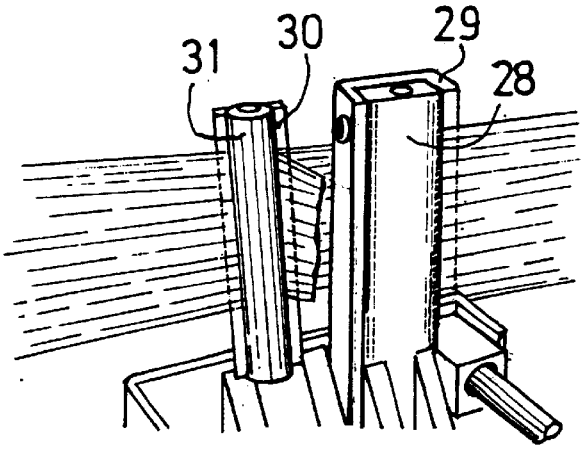
Figure 3:
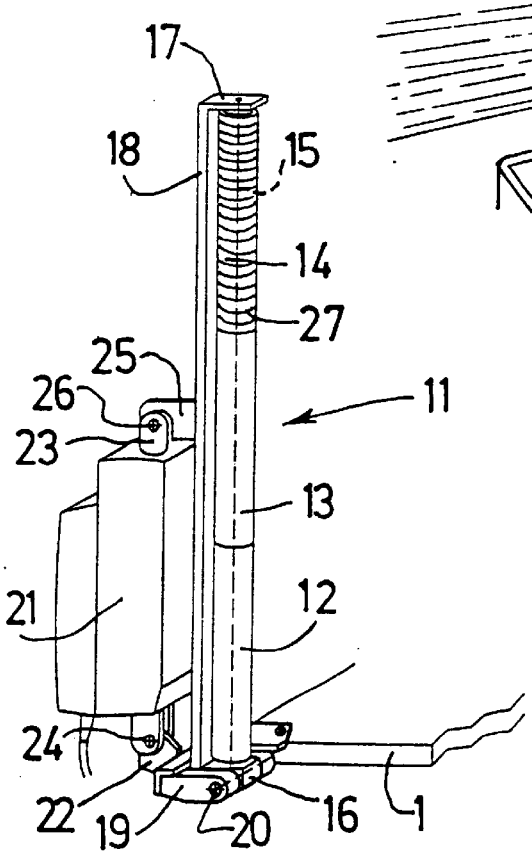

The invention will be better understood with the aid of the following description of the preferred embodiment of the machine of the invention with reference to the appended drawing in which:

FIG. 1 is a view in perspective from above of the pleating device of the machine, FIG. 2 is a simplified view from above of the device of FIG. 1, FIG. 3 is a profile side view of the distancing bar of the device of FIG. 1, FIG. 4 is a view in perspective of the cutting and welding device of the machine of the invention, and FIG. 5 is a view of the cutting and welding jaw and mating jaw of the device of FIG. 4 during a wrapping cycle.

The machine comprises a stand 1 carrying a feed reel 2 of a width of wrapping film, a platform 3 carrying a pallet supporting a load that is to be wrapped and, shown in this instance as being able to rotate about itself to wind the width of film around the load and its pallet, and near to the platform 3, a device 4 for cutting and welding the width, which will be described only briefly because the invention does not concern it.

Beside the reel 2 is mounted, on the stand 1, a device 5 for pre-stretching and pleating the width of film for, by pleating, reducing the breadth of the width to the dimensions of the elements of the cutting and welding device 4.

The width of film 6 has an initial breadth equal to the separation of its two, top 7 and bottom 8, lateral edges. Under the action of the rotation of the load-support platform, the width of film 6 is unwound from the reel 2, passes, in the conventional way, through a gang 9 of pre-stretching and turn rolls of the device 5, these having axes parallel to that of the reel 2 and being protected by a casing 10, before being pleated by the distancing bar 11 of the pre-stretching and pleating device constituting the pleating part of the device 5, also termed the pleating device.

The distancing bar 11 consists of rolls, in this instance three rolls 12, 13, 14, mounted end to end but free to rotate on themselves about a rod 15 fixed to two lugs 16, 17 of a broad calliper 18.

The bottom lug 16 is mounted so that it can pivot, about an axis 20, in a fork 19 fixed to the stand 1. The portions of the bar 11 which are adjacent to the two lugs are known as the bottom and the top of the bar, respectively. This bottom and this top of the bar will also be likened to the calliper lugs 16, 17.

It will have been noted that the distancing bar 11 is mounted articulated on the fork 19 so that it can pivot about the axis 20, in this particular instance on the same side as the reel 2.

On the opposite side, a ram 21 extends along the calliper 18 mounted articulated about an axis 24, at the bottom end of its casing, on a cheek 22 secured to the fork 19 and to the stand 1. At its upper end, in fact via the free end of its piston 23, the ram is articulated, about an axis 26, on a transverse strut 25 of the calliper 18.

Because of the separation between the axes 20, 24 of articulation of the calliper 18 and of the ram 21, when the ram is actuated, the deployment of the piston 23 from the ram casing forces the calliper 18, and with it the distancing bar 11, to pivot to follow the increase in separation of the two axes, 24, 26, of articulation of the ram 21, the ram 21 naturally accompanying the calliper 18 in its pivoting. It will be noted that the attachment of the strut 25 to the calliper 18 and the three axes 20, 24, 26 of articulation can be qualified as an articulated polygon. The bar 11 and the ram 21 form this articulated polygon.

The width of film 6 passes along the distancing bar 11 on the side where it pivots.

By pivoting the bar 11, the width 6 is pleated, in so far as its top lateral edge 7 slips downwards, towards the bottom of the bar, its bottom lateral edge 6 remaining practically level with the bottom of the bar. This is the case because the top of the bar, in pivoting, moves away from the vertical line through the bottom, stretches out the width, more at the top than at the bottom, and this forces the portion of width adjacent to its top lateral edge 7, against the top of the bar, to slip towards the bottom of the bar to compensate for this distancing.

As the distancing of the width 6, after the pivoting of the bar 11, is gradual from the bottom upwards, the various longitudinal portions of the width 6 travel against the bar 11 at different speeds, and with a speed gradient, at the nominal speed against the bottom of the bar, at a maximum speed against the top of the bar. This is why the distancing bar has been "chopped" into a number of rolls 12–14 rotating at different speeds under the action of the travel of the width 6, the top roll 14 rotating the most quickly to best avoid the top part of the width 6 adjacent to the top edge 7 rolling up on itself and forming a twist. Furthermore, to even better avoid the formation of a twist as the two lateral edges 7, 8 of the width 6 are brought closer together, the "head" roll 14, against which the top part of the width 6 travels, has circumferential striations 27 causing friction on the width 6 and preventing it from rolling up on itself.

On exiting the pre-stretching and pleating device 5 downstream of the distancing bar 11 of this device, the breadth of the width 6 thus pleated is therefore perfectly reduced so that the width, at the end of the wrapping cycle, can be gripped between the welding jaw 28 and mating jaw 29 and gripped between the gripper shoe 30 and finger 31 so as, after cutting, to hold the tail end of the width ready for the next wrapping cycle. It will be noted that the width is cut between the gripping shoe 30 and the welding jaw 28.

What is claimed is:

1. The wrapping machine for winding a width of film with a top lateral edge and a bottom lateral edge of a reel of wrapping film around the load, comprising a frame, a reel holder connected to the frame, means connected to the frame for winding the width of film around the load, a device connected to the frame for cutting and welding the width of film and a device connected to the frame for pleating the width of film, the pleating device being intended to bring the two lateral edges of the width of film closer together, wherein the pleating device is adapted for bringing the two lateral edges of the width of film closer together by sliding the top lateral edge downwards, the pleating device comprising a distancing bar wherein the distancing bar base articulates with the frame and the distancing bar comprises a longitudinally mounted rotatable section, wherein the distancing bar comprises more than one rotatable section, wherein the sections are independently rotatable of each other to prevent the top part of the width of film from rolling up and forming a twist.

2. The wrapping machine according to claim 1, in which the top portion of the distancing bar is a roll with circumferential striations.

3. A load wrapping machine, for winding a width of film with a top lateral edge and a bottom lateral edge of a reel of wrapping film around the load, comprising a frame, a reel holder connected to the frame, means connected to the frame for winding the width of film around the load, a device connected to the frame for cutting and welding the width of film and a device connected to the frame for pleating the width of film, the pleating device being intended to bring the two lateral edges of the width of film closer together, wherein the pleating device is adapted for bringing the two lateral edges of the width of film closer together by sliding the top lateral edge downwards, the pleating device comprising a distancing bar wherein the distancing bar base articulates with the frame and the distancing bar comprises a longitudinally mounted rotatable section, in which the distancing bar comprises, towards its top, friction means intended to apply relative retention to the width of film.

4. A pleating device for a load wrapping machine for winding a width of film, the film having a top lateral edge and a bottom lateral edge, comprising:

a pleating device connectable to the load wrapping machine adapted for pleating the width of film, the pleating device adapted to bring the two lateral edges of the width of film closer together by sliding the top lateral edge downward and without sliding the bottom lateral edge upward, the pleating device comprises a distancing bar wherein the distancing bar base includes means for mounting the pleating device to allow articulation relative to the load wrapping machine and the distancing bar comprises a longitudinally mounted rotatable section wherein the distancing bar comprises more than one rotatable section, wherein the sections are independently rotatable of each other to prevent the top part of the width of film from rolling up and forming a twist.

* * * * *